US010760307B2

(12) United States Patent
Rocci et al.

(10) Patent No.: US 10,760,307 B2
(45) Date of Patent: Sep. 1, 2020

(54) HANDLE FOR A VEHICLE DOOR

(71) Applicant: U-Shin Italia S.P.A, Pianezza (IT)

(72) Inventors: Antonio Rocci, Settimo Torinese (IT); Anthony Guerin, Creteil (FR)

(73) Assignee: U-SHIN ITALIA S.P.A., Pianezza (IT)

( * ) Notice: Subject to any disclaimer, the term of this patent is extended or adjusted under 35 U.S.C. 154(b) by 957 days.

(21) Appl. No.: 15/177,395

(22) Filed: Jun. 9, 2016

(65) Prior Publication Data

US 2016/0369537 A1 Dec. 22, 2016

(30) Foreign Application Priority Data

Jun. 16, 2015 (EP) ..... 15172433

(51) Int. Cl.

| | |
|---|---|
| ***E05B 85/14*** | (2014.01) |
| ***E05B 85/10*** | (2014.01) |
| ***E05B 79/20*** | (2014.01) |
| ***E05B 85/16*** | (2014.01) |
| ***E05B 81/76*** | (2014.01) |
| *E05B 81/06* | (2014.01) |

(Continued)

(52) U.S. Cl.

CPC ..... *E05B 79/20* (2013.01); *E05B 81/76* (2013.01); *E05B 85/103* (2013.01); *E05B 85/107* (2013.01); *E05B 85/16* (2013.01); *E05B 81/06* (2013.01); *E05B 81/16* (2013.01); *E05B 81/64* (2013.01); *E05B 81/84* (2013.01)

(58) Field of Classification Search

CPC ..... E05B 85/103; E05B 85/107; E05B 81/76
USPC ..... 292/336.3
See application file for complete search history.

(56) References Cited

U.S. PATENT DOCUMENTS 5,123,687 A * 6/1992 Pfeiffer ..... E05B 1/0092 292/336.3
6,598,912 B2 * 7/2003 Hillgaertner ..... E05B 13/005 292/225

(Continued)

FOREIGN PATENT DOCUMENTS

DE 3427178 A1 * 2/1986 ..... E05B 85/18
DE 19731325 A1 * 1/1999 ..... B60N 3/023

(Continued)

OTHER PUBLICATIONS

Extended European Search Report issued in corresponding European Patent Application No. 15172433.3, dated Jan. 28, 2016 (13 pages).

*Primary Examiner* — Carlos Lugo
(74) *Attorney, Agent, or Firm* — Burris Law, PLLC

(57) ABSTRACT

The invention relates to a handle that includes an activation member for activating a latch of a vehicle door to unlatch the door and a grip member that cooperates with the activation member to unlatch the door. The grip member has a gripping part and is movable between a flushing position in which the gripping part extends flush to an external panel of the door, an active position in which the gripping part projects with respect to the external panel, becoming graspable, and an opening position in which the grip member drives the activation member to unlatch the door. The handle has a driving mechanism and an actuator lever cooperating with the grip member to drive the latter between the flushing and the active position. When the grip member is pulled in an opening direction, the grip member drives the activation member which unlatches the door.

17 Claims, 6 Drawing Sheets

(51) Int. Cl.

| | |
|---|---|
| *E05B 81/16* | (2014.01) |
| *E05B 81/64* | (2014.01) |
| *E05B 81/84* | (2014.01) |

(56) References Cited

U.S. PATENT DOCUMENTS

| | | | | |
|---|---|---|---|---|
| 6,698,262 | B2 * | 3/2004 | Wittwer | E05B 85/107<br>292/336.3 |
| 8,482,394 | B2 * | 7/2013 | Nass | E05B 85/26<br>292/201 |
| 9,322,191 | B2 * | 4/2016 | Muller | E05B 85/107 |
| 10,280,658 | B2 * | 5/2019 | Halliwell | E05B 85/107 |
| 2002/0121786 | A1 | 9/2002 | Meinke | |
| 2004/0195845 | A1 * | 10/2004 | Chevalier | E05B 77/48<br>292/201 |
| 2014/0265372 | A1 * | 9/2014 | Smart | E05B 85/103<br>292/336.3 |
| 2017/0130493 | A1 * | 5/2017 | Guerin | E05B 85/107 |

FOREIGN PATENT DOCUMENTS

| | | | | |
|---|---|---|---|---|
| DE | 19740827 | A1 * | 3/1999 | E05B 85/10 |
| EP | 2730730 | A2 | 5/2014 | |
| FR | 3023865 | A1 * | 1/2016 | E05B 77/06 |
| GB | 2506350 | A | 4/2014 | |
| WO | 2015073119 | A1 | 5/2015 | |

* cited by examiner

HANDLE FOR A VEHICLE DOOR

The present invention relates to handles for a vehicle door, also called "flush handles".

Handles for vehicle doors are components having a significant influence on the style of vehicles. In this respect, vehicle manufacturers often seek to arrange the handle in the plane of the door so that it occupies a flush position also called a flush arrangement. A flush handle generally renders the handle as invisible as possible. Such flush door handles also have the advantage of reducing the aerodynamic noise caused by the rush of air as the vehicle is being driven along.

A flush handle has been proposed with a grip member and a moveable flap configured to be moved by a user to grab the grip member and pull the grip member to open the vehicle door.

Such a handle requires an arrangement with additional pieces including means for maintaining the flap so as to avoid movements of the flap when the car is moving.

Moreover, such a handle turns out inconvenient in use as the user needs to make preliminary movements to have access to the grip member. Indeed, there is a need of a handle wherein the grip member is moved to an active position to be grabbed, to limit the preliminary movements of the user.

An object of the invention is to propose a flush handle where a flap is not needed, and wherein the preliminary movements of the user are reduced.

To this end the invention relates to a handle for a vehicle door, comprising:

- an activation member configured to activate a latch of a vehicle door so as to unlatch the door, and
- a grip member configured to cooperate with the activation member so as to unlatch the door,
- wherein the grip member comprises a gripping part, the grip member being movable between:
  - a flushing position in which the gripping part extends flush to an external panel of the door,
  - an active position in which the gripping part projects with respect to the external panel and becomes graspable, and the grip member cooperates with the activation member, and
  - an opening position in which the grip member drives the activation member to activate the latch and unlatch the door, and
- a driving mechanism and an actuator lever cooperating with the grip member such that the grip member may be driven between the flushing position and the active position,
- the handle being configured such that when the grip member is pulled according to an opening direction, the grip member drives the activation member which in turn activates the latch to unlatch the door.

Advantageously, the flush handle of the invention has a simple arrangement in which a flap is not needed, thereby making the handle more convenient to use.

According to further embodiments which can be considered alone or in combination:

- the handle further comprises a grip return means configured to drive the grip member towards the flushing position, and
  - the actuator lever is moveable between:
    - an activating position in which the actuator lever drives the gripping member towards the active position, and
    - a rest position in which the actuator lever releases the grip member,

- and the handle further comprises:
    - an actuator return means configured to drive the actuator lever towards the activating position, and
    - a retaining means for retaining the actuator lever in the rest position; and/or
- the handle further comprises a grip return means configured to drive the grip member towards the active position,
  - the actuator lever is moveable between:
    - a locking position in which the actuator lever blocks the grip member in the flushing position, and
    - an unlocking position in which the actuator lever enables the grip member to move towards the active position, and
  - and the handle further comprises:
    - an actuator return means configured to drive the actuator lever towards the locking position, and
    - a retaining means for retaining the actuator lever in the unlocking position; and/or
- the retaining means comprises a pressure sensitive bistable spring mechanism connected to the actuator lever and to a bracket, the bistable spring mechanism being movable between a retaining state in which the actuator lever is retained in the rest position or in the unlocking position, and a releasing state in which the actuator lever is released from said position; and/or
- the retaining means comprises clicking means configured to produce a clicking sound when the actuator lever is released from the rest position or from the unlocking position; and/or
- the actuator lever is driven by a motor; and/or
- the driving mechanism comprises a motor configured to drive the actuator lever which in turn drives the grip member between the flushing position and the opening position; and/or
- the handle further comprises at least one first switch and a first circuit, closed by a contact between the activation member and the grip member; and/or
- the handle further comprises at least one second switch on the motor or on the actuator lever and at least one second circuit, the at least one second switch and the second circuit being configured to inform a user on the state of the actuator lever; and/or
- the grip member comprises a driven structure and the actuator lever comprises a driving structure cooperating with the driven structure,
- and when the actuator lever is moved from the rest position to the activating position, the driving structure drives the driven structure such that the gripping part is moved from the flushing position to the active position; and/or
- the grip member comprises a first locking structure and the actuator lever comprises a second locking structure cooperating with the first locking structure,
- and when the grip member is moved from the active position to the opening position, the first locking structure drives the second locking structure so as to drive the actuator lever towards the rest position such that the actuator lever presses and is retained by the retaining means; and/or
- the grip member comprises a first locking structure defining a first trajectory when the grip member is moved from the flushing position to the active position, and the actuator lever comprises a second locking structure,
- in the locking position, the second locking structure blocks the first locking structure so as to block the grip member in the flushing position, and in the unlocking position, the second locking structure is moved out of the first trajectory of the first locking structure; and/or the grip member comprises a driving structure and the actuator lever comprises a driven structure cooperating with the driving structure such that when the grip member is in the flushing position and the gripping part is pressed from outside the door, the driving structure drives the driven structure such that the actuator lever presses the retaining means which in turn releases the actuator lever from the unlocking position; and/or when the gripping part moves from the active position to the opening position, the first locking structure cooperates with the second locking structure so as to drive the actuator lever along a second trajectory such that the actuator lever presses the retaining means which in turn releases the actuator lever from the unlocking position; and/or the grip member is rotatably mounted about a grip axis and the actuator lever is rotatably mounted about an actuator axis and the grip axis and the actuator axis are substantially parallel to each other; and/or the grip member comprises a column projecting towards the external panel and the column comprises a first opening protuberance cooperating with a second opening protuberance on the activation member to unlatch the vehicle door, the driving structure being on the column; and/or the actuator lever has two opposite ends, and the second locking structure is placed at one end and the driven structure is placed at the opposite end.

According to a second aspect, the handle of the invention comprises:

an activation member configured to activate a latch of a vehicle door so as to unlatch the door, a grip member configured to cooperate with the activation member so as to unlatch the door, wherein the grip member comprises a gripping part, the grip member being movable between:

a flushing position in which the gripping part extends flush to an external panel of the door, an active position in which the gripping part projects with respect to the external panel and becomes graspable, and the grip member cooperates with the activation member, and an opening position in which the grip member drives the activation member to activate the latch and unlatch the door, and a grip return means configured to drive the grip member towards the flushing position, and an actuator lever cooperating with the grip member, wherein the actuator lever is moveable between an activating position in which the actuator lever drives the gripping member towards the active position, and a rest position in which the actuator lever releases the grip member, an actuator return means configured to drive the actuator lever towards the activating position, and a retaining means for retaining the actuator lever in the rest position, the handle being configured such that when the grip member is pulled according to an opening direction, the grip member drives the activation member which in turn activates the latch to unlatch the door.

According to another aspect, the handle of the invention comprises:

an activation member configured to activate a latch of a vehicle door so as to unlatch the door, a grip member configured to cooperate with the activation member so as to unlatch the door, wherein the grip member comprises a gripping part, the grip member being movable between a flushing position in which the gripping part extends flush to an external panel of the door, an active position in which the gripping part projects with respect to the external panel and becomes graspable, and the grip member cooperates with the activation member, and an opening position in which the grip member drives the activation member to activate the latch and unlatch the door, and a grip return means configured grip return means configured to drive the grip member towards the active position, an actuator lever cooperating with the grip member, wherein the actuator lever is moveable between a locking position in which the actuator lever blocks the grip member in the flushing position and an unlocking position in which the actuator lever enables the grip member to move towards the active position, and an actuator return means configured to drive the actuator lever towards the locking position, and a retaining means for retaining the actuator lever in the unlocking position.

According to another aspect, the handle of the invention comprises:

an activation member configured to activate a latch of a vehicle door so as to unlatch the door, a grip member configured to cooperate with the activation member so as to unlatch the door, wherein the grip member comprises a gripping part, the grip member being movable between a flushing position in which the gripping part extends flush to an external panel of the door, an active position in which the gripping part projects with respect to the external panel and becomes graspable, and the grip member cooperates with the activation member, and an opening position in which the grip member drives the activation member to activate the latch and unlatch the door, and a driving mechanism and an actuator lever cooperating with the grip member, the driving mechanism comprising a motor configured to drive the actuator lever which in turn drives the grip member between the flushing position and the opening position, wherein the handle is configured such that when the grip member is pulled according to an opening direction, the grip member drives the activation member which in turn activates the latch to unlatch the door.

Other features and advantages of the present invention will become apparent from the following description of non-limitative embodiments, with reference to the attached drawings in which:

FIGS. 1 to 8 concern a handle with a motorized actuation lever according to a first embodiment of the invention;

Figure 9:
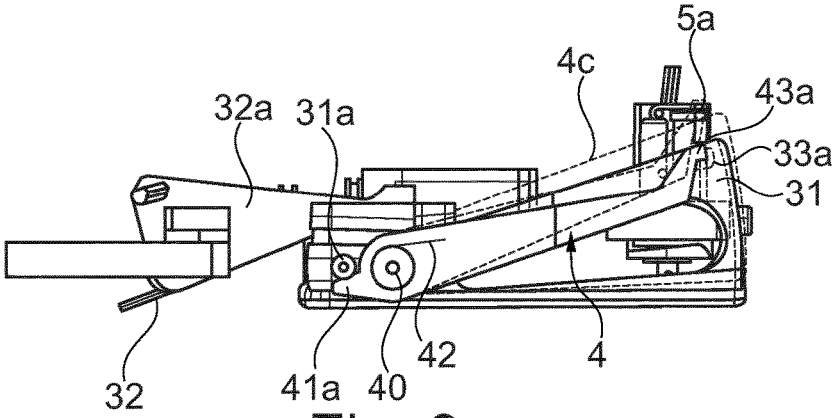
Figure 10:
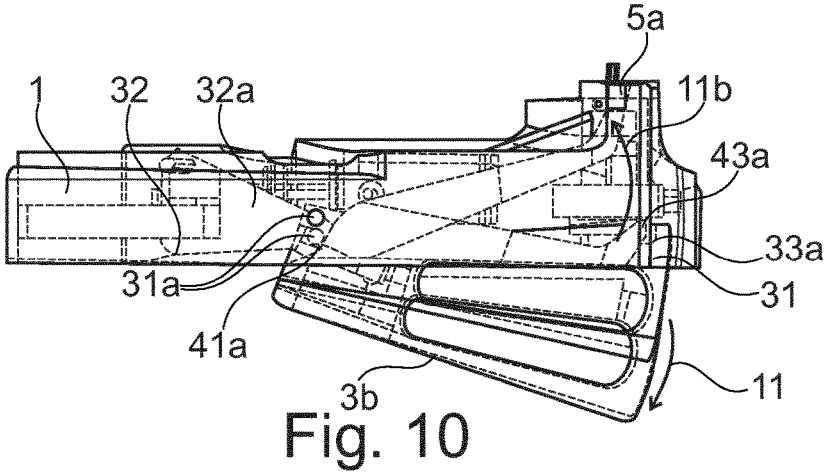
Figure 11:
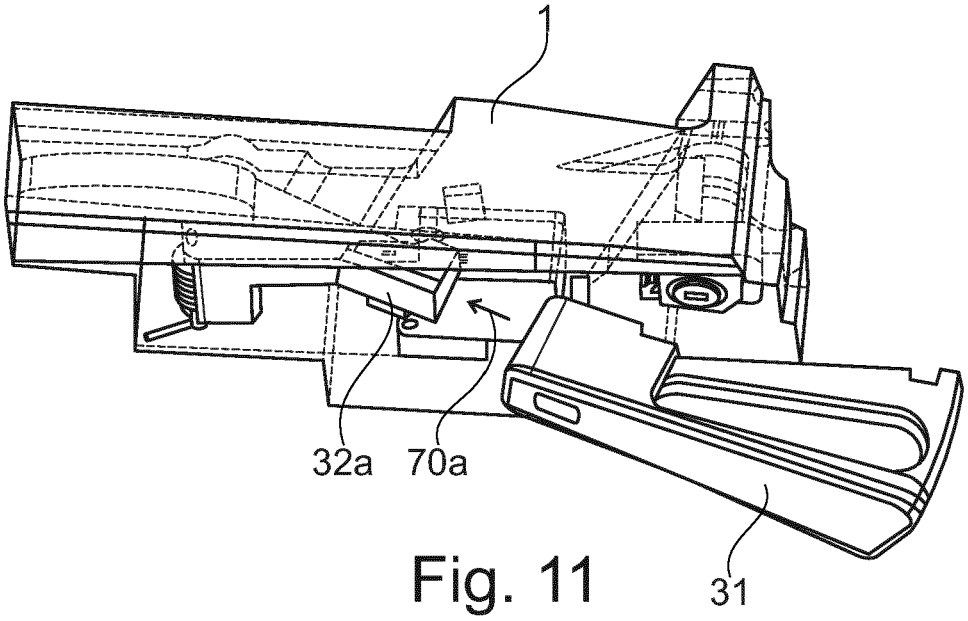
Figure 12:
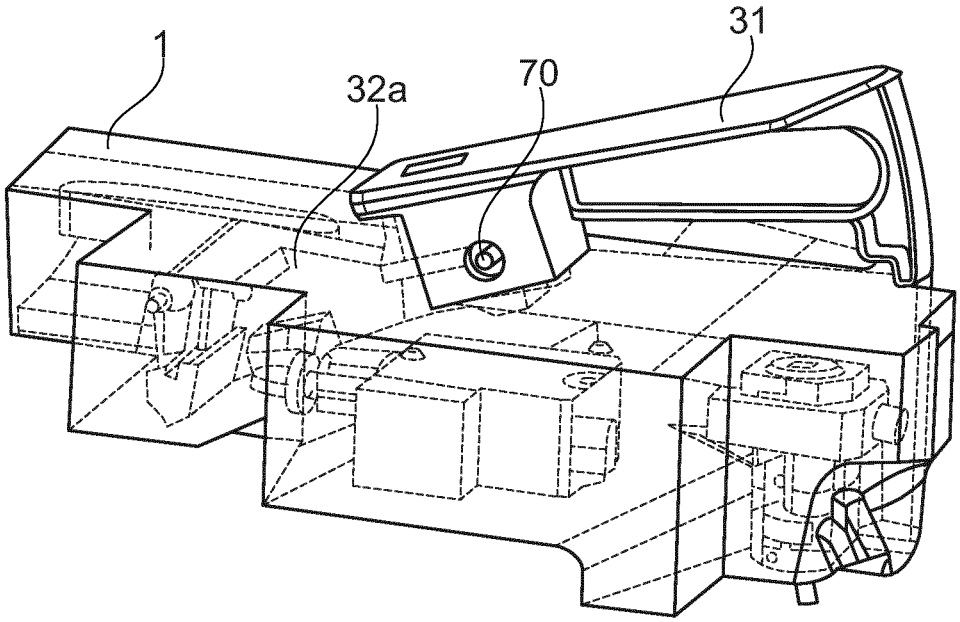
Figure 13:
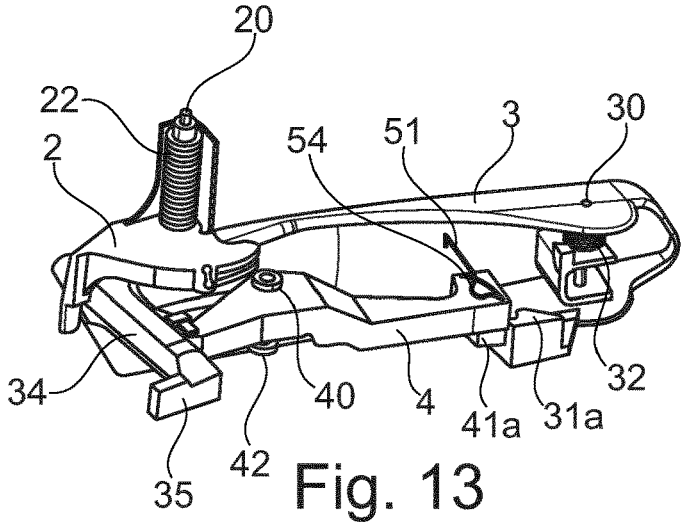
Figure 14A:
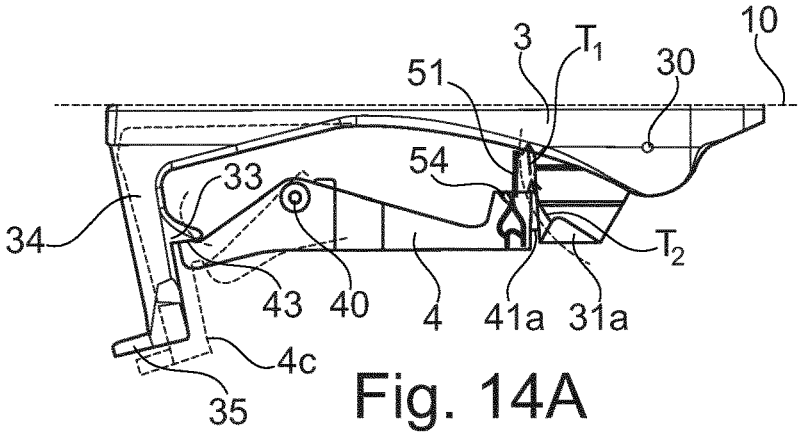
Figure 14B:
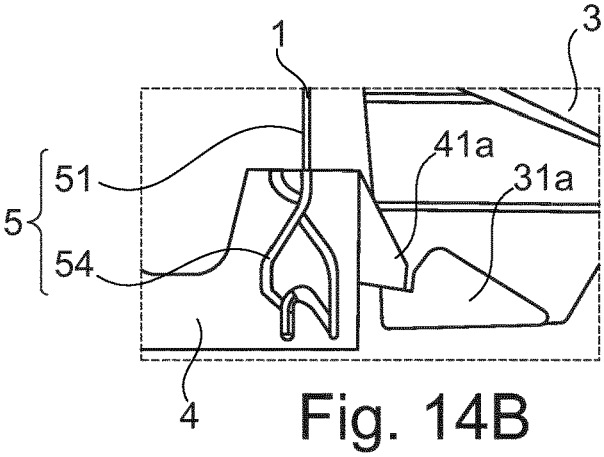
Figure 14C:
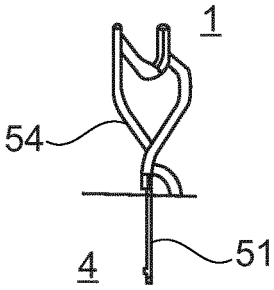
Figure 15:
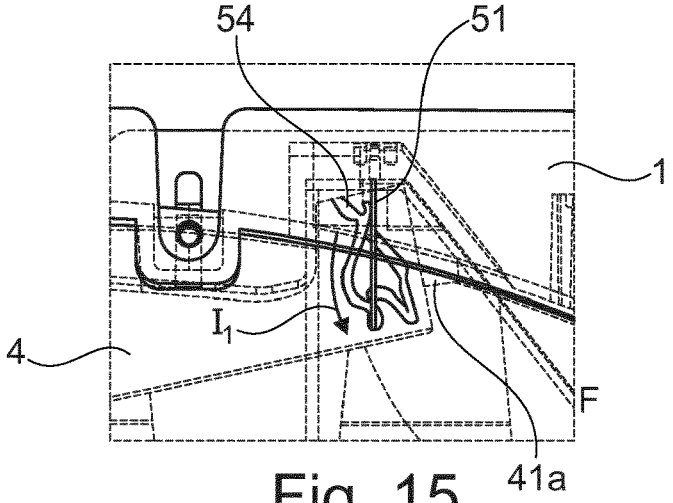
Figure 16:
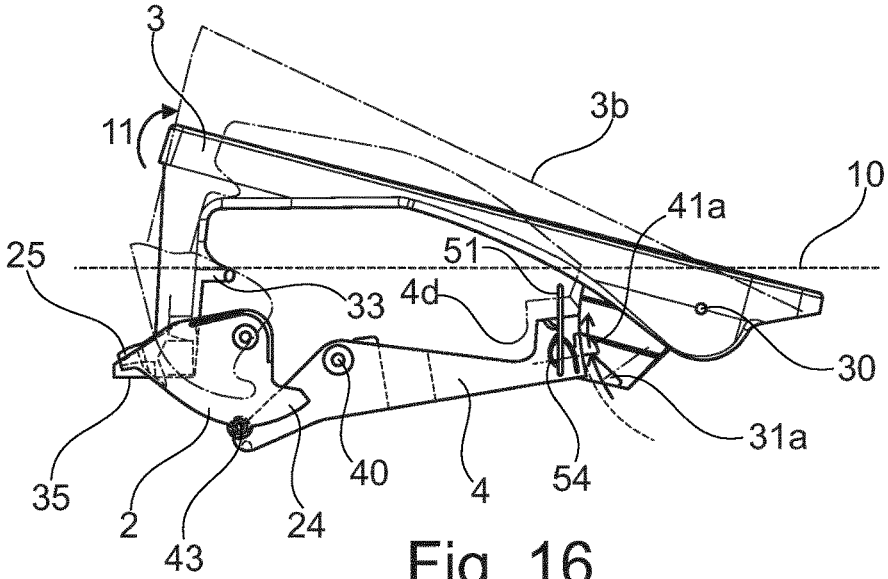
Figure 17:
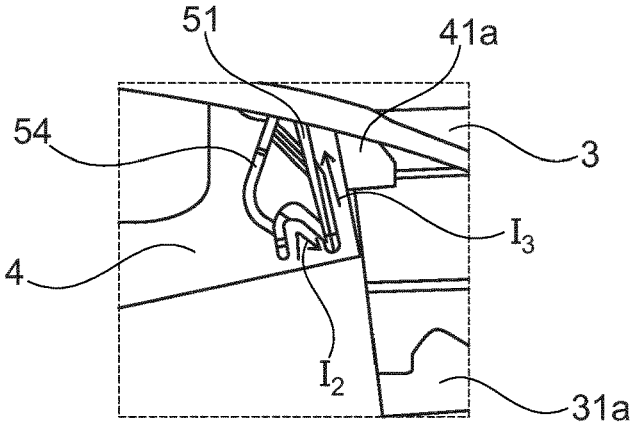

FIGS. 9 to 12 concern a handle according to a second embodiment is similar to the first embodiment, in which the actuation lever is not motorized;

FIGS. 9 and 10 are top views of the handle of the second embodiment in various positions;

FIGS. 11 and 12 are space views showing the assembling of the handle of the second embodiment;

FIGS. 13 to 17 concern a handle according to a third embodiment similar to the second embodiment, with a different arrangement of the actuation lever;

FIG. 13 is a space view of the handle of the third embodiment of the invention;

FIGS. 14A and 14B are a top view of the handle of FIG. 13 in the flushing position;

FIGS. 14B, 14C, 15 and 17 show a details of bistable spring arrangements;

FIG. 14C is a top view of a bistable spring arrangement in an alternative third embodiment;

FIGS. 15 and 16 are a top view of the handle of FIG. 13 in the active position;

FIG. 17 is a top view of a bistable spring arrangement in the handle of FIG. 13 in the opening position.

Referring to FIGS. 1 to 8, the handle according to the first embodiment of the invention comprises a grip member 3 and an activation member 2. The handle enables a user to open a vehicle door comprising an external panel 10.

Figure 2:
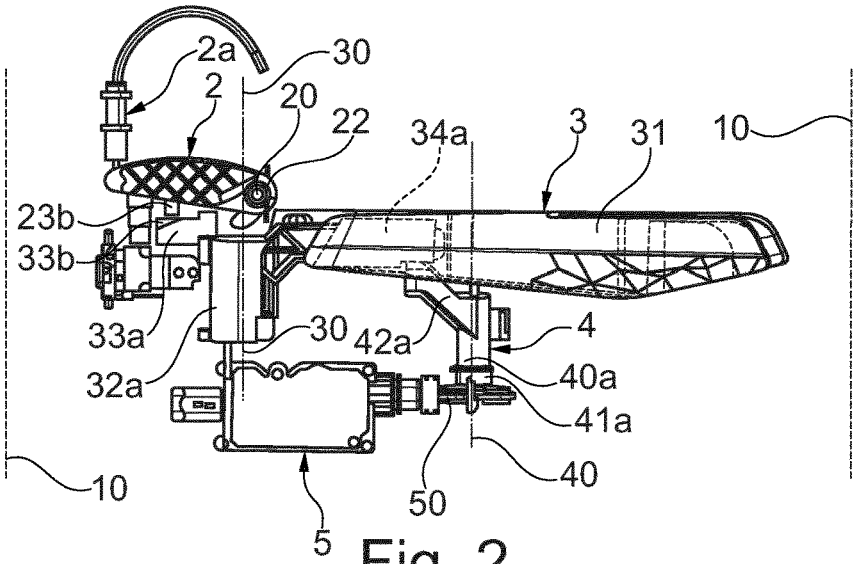
FIGS. 2 and 5 are side views of the handle of FIGS. 2 and 4.

The activation member 2 is configured to activate a latch 2*a*. The latch 2*a* comprises a Bowden cable as shown in FIG. 2. In particular, the activation member 2 pulls the Bowden cable such that the door is unlatched and may be opened.

The activation member 2 is a longitudinal lever. The activation member 2 is rotationally mounted about an activation axis 20 shown in FIGS. 2 and 5.

The grip member 3 comprises a gripping part 31 and a grip lever 32*a*. The gripping part 31 is configured to be grasped by a user trying to open the door. The gripping part 31 is connected to the grip lever 32*a*.

The grip lever 32*a* has a first arm 34*a* connected to the gripping part 31 and a second arm 33*a* configured to cooperate with the activation member 2. The grip lever 32*a* is rotationally mounted about a grip axis 30.

The grip lever 32*a* is configured to cooperate with the activation member 2 to activate the latch 2*a*. In particular, the grip lever 32*a* comprises a cam surface 33*b* on which a protuberance 23*b* of the activation member slides such that the activation member 2 is rotated about the rotation axis 20 and activates the latch 2*a*.

The gripping part 31 comprises a recess configured to receive at least one or more fingers so as to be grasped. The handle is configured such that when the gripping part 31 is pulled downwardly according to reference 3*b* in FIG. 6, the grip lever 32*a* is rotated about the grip axis 30 in an opening direction, which is here a clockwise direction, in reference to FIGS. 3 and 6. As the grip lever 32*a* is rotated, the protuberance 23*b* of the activation member 2 slides on the cam surface 33*b* such that the activation member 2 activates the latch 2*a*.

The grip member 3 is movable between a flushing position, an active position and an opening position.

Figure 1:
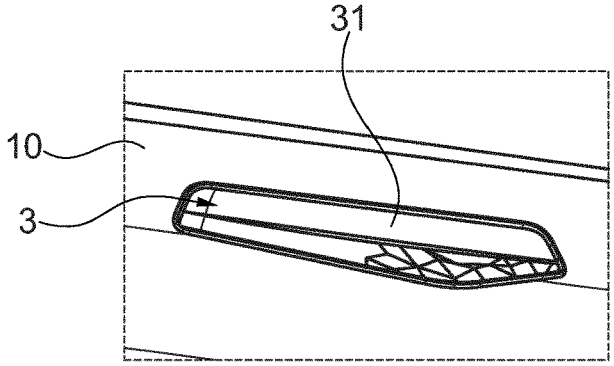
FIGS. 1 and 4 are space views of the handle of the first embodiment in the flushing and active positions.
Figure 3:
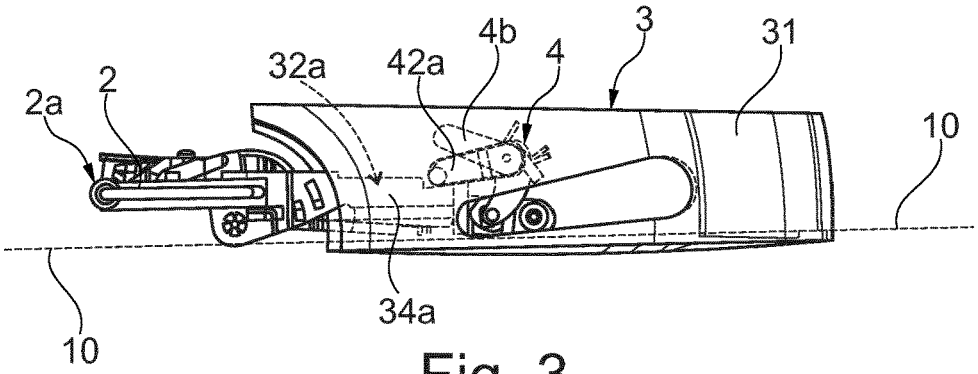
FIGS. 3 and 6 are top views of the handle of FIGS. 2 and 4.

The flushing position is shown in FIGS. 1 to 3. In this position the gripping part 31 extends flush to an external panel 10 of the door. To this end, the gripping part 31 comprises an external surface substantially aligned with the external panel 10 as shown in FIGS. 1 and 3. In FIGS. 1 and 2, the external panel 10 extends along the plane of the drawing sheet.

Figure 4:
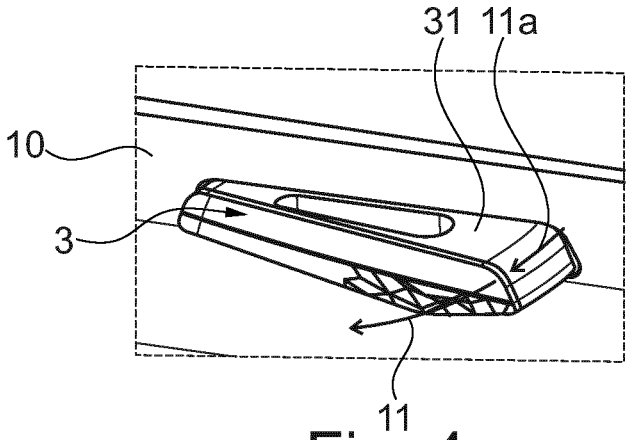
Figure 5:
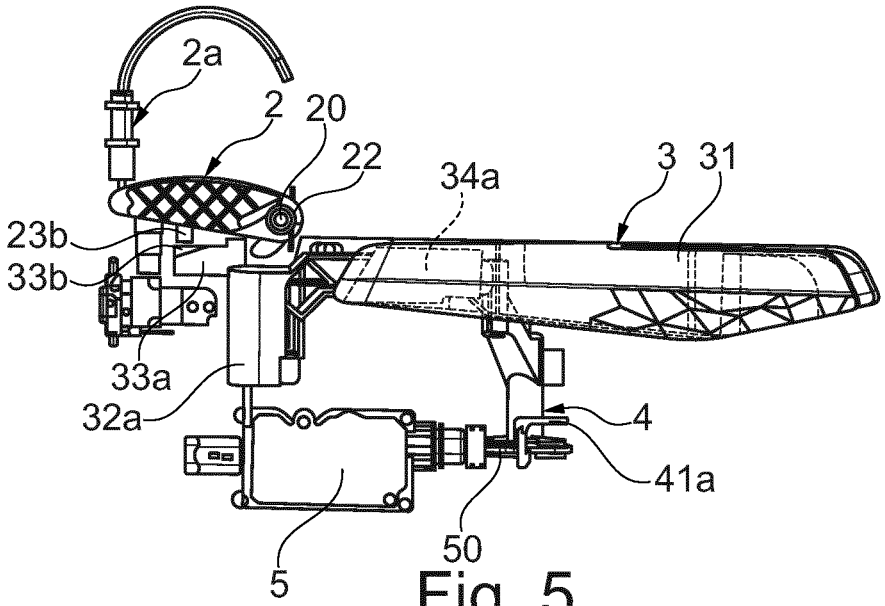
Figure 6:
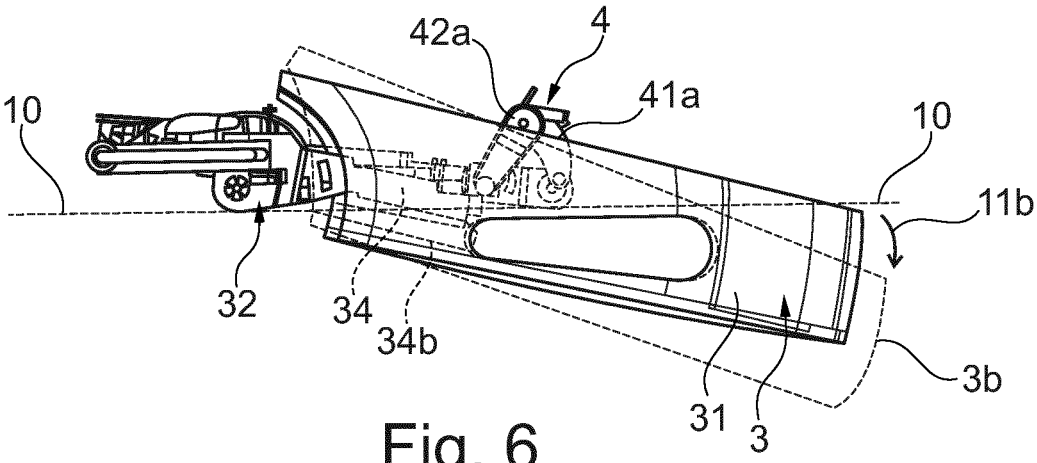

The active position is shown in FIGS. 4 to 6. In this position the gripping part 31 projects outwardly with respect to the external panel 10 such that the grip recess is accessible by a user. This movement is shown by arrow 11*a*.

In addition, the grip member is configured to cooperate with the activation member 2 when put in the active position. In particular, the grip lever 32*a* is brought closer the activation member such that the protuberance 23*b* of the activation member 2 contacts the cam surface 33*b*, and may slide if the gripping part is actuated. To this end, as shown in FIGS. 2 and 4, the arm 33*a* and the cam surface 33*b* are shifted to the right of the figures and the cam surface 33*b* is placed in front of the protuberance 23*b*.

Figure 7:
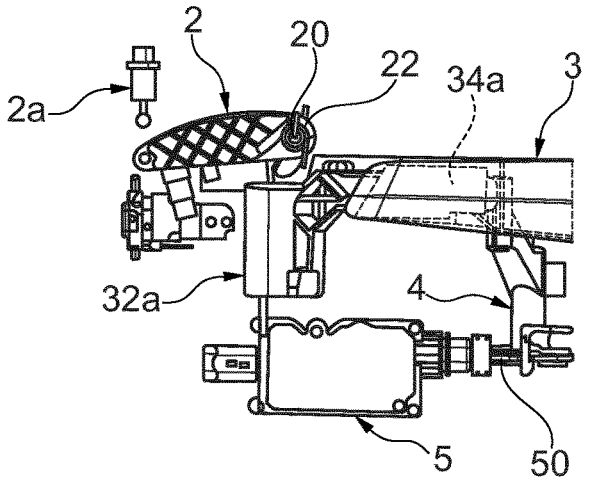
FIG. 7 is a side view of the handle of the first embodiment in the opening position.

The opening position is shown by reference 3*b* in FIG. 6 and FIG. 7. The grip member 3 is configured to reach this position after being in the active position. In this position the gripping part 31 is pulled outwardly according to the arrow 11 such that the grip lever 32*a* cooperates with the activation member 2 to unlatch the door.

When the gripping part 31 is moved according to an outward direction as sown by arrow 11 in FIG. 6, so as to reach the open position shown by reference 3*b*, the grip lever 32*a* is also rotated about the grip axis 30 and the second arm 34*a* reaches the position 34*b*. In addition, the activation lever 2 rotates about the activation axis 20 to unlatch the vehicle door.

The handle of the invention further comprises an actuator lever 4 configured to cooperate with the grip member 3 so as to drive the grip member 3 between the flushing position and the active position.

In the first embodiment, the actuator lever 4 cooperates with the grip lever 32*a* to drive the grip member 3 from the flushing position to the active position as shown in FIGS. 1 to 6. More particularly, the actuator lever 4 is configured to push the grip lever 32*a* and thereby cause the gripping part 31 to project outwardly with respect to the external panel 10 of the vehicle door.

The actuator lever 4 has a central shaft 40*a* having two extremities, in particular an upper end and a lower end. The actuator lever 4 further comprises a driving shaft 41*a* and a driven shaft 42*a*. The driven shaft 42*a* is connected to the upper end of the central shaft 40*a*. The driving shaft 41*a* is connected to the lower end of the central shaft 40*a*.

The driven shaft 42*a* is configured to cooperate with the second arm 34*a* of the grip lever 32*a* to move the grip member 3 from the flushing position to the active position. To this end, the actuator lever 4 is rotationally mounted about an actuator axis 40 passing through the central shaft 40*a*.

The actuation lever preferably has an inactive position 4*b* in which the driven shaft 42*a* is away from the arm 34*a* of the grip lever 32*a*.

The grip member 3 is preferably spring biased to move from the opening position to the active position.

In the first embodiment, the actuator lever 4 is actuated by a motor 5 comprising a motor shaft 50 connected to the driving shaft 41.

In operation, when the grip member 3 is in the flushing position, the user wanting to open the corresponding vehicle door gives information to the driving system for example by means of a wireless transmission through the vehicle key or the like. The motor 5 receives the information and drives the actuation lever 4 which in turn drives the grip member 3, in particular the grip lever 32*a*, such that the grip member 3 is moved from the flushing position to the active position.

When the grip member 3 is in the active position, the user may pull the gripping part 31 according to an opening direction 11 toward the open position such that the grip member drives the activation member 2 to open the door. In this movement, the grip member is disengaged from actuator lever 4 as shown in FIG. 6, reference 3*b* disengaged from arm 42*a* of the actuator lever 4.

The grip member 3 preferably comprises grip return means configured to make the grip member 3 return from the opening position to the active position, and preferably to the flushing position.

In particular, the actuation lever 4 is configured to enable the grip member 3 to return to the flushing position.

In an alternative embodiment, the motor 5 through the actuator lever 4 could also drive the grip member 3 from the active position to the flushing position 5.

According to an alternative embodiment, actuator lever 4 may be configured to make a clicking sound when the signal from the key or the like is received, and then driving mechanism starts to drive the grip member from the flushing position to the active position.

The clicking sound informs the user that the signal is received and that the driving mechanism is in course of making the grip member come from the flushing position to the active position.

Figure 8:
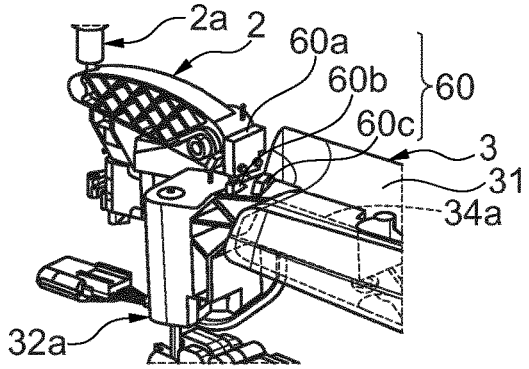
FIG. 8 is a space view of the handle of the first embodiment showing the switches.

According to another alternative embodiment shown in FIG. 8, the handle may comprise at least one activation switch 60 configured to indicate that the activation member 2 is contacting the grip member 3, in particular the arm 34*a* of grip lever 32*a*.

The activation switch 60 comprises one part 60*a* on the activation element 2 and at least one part 60*b* and 60*c* on the arm 34*a* of the grip lever 32*a*. The activation switch 60 is part of an activation circuit (not represented) which indicates the contact between the activation member 2 and the arm 34*a*.

The handle may further comprise one or more motor switches configured to indicate the rotational state of the activation member 2. To this end, the motor switches are part of a motor circuit (not represented).

The switches may also inform the driving mechanism that opening is exerted and trigger an operation of the motor in the opposite sense such that the grip member 3 may return to the flushing position.

Referring to FIGS. 9 to 12, the handle according to a second embodiment of the invention is similar to the one of the first embodiment, wherein the actuator lever 4 is not driven by a motor. The activation member 2 and the latch 2*a* of this embodiment are not shown in detail in the figures.

The grip lever 32*a* has a single arm 33*a* connected to the gripping part 31.

In the second embodiment, the flushing position is shown in FIG. 9, the active position is shown in FIGS. 10 and 12, and the opening position is shown by reference 3*b* in FIG. 10. Space views of the flushing and active positions are similar to FIGS. 1 and 4.

In the second embodiment, the actuator lever 4 cooperates with the gripping part 31 to drive the grip member 3 from the flushing position to the active position. More particularly, the actuator lever 4 comprises an actuator return means 42 which is a spring 42, configured to drive the actuator lever 4 which in turn drives the grip member 2, in particular the gripping part 31 such that the grip member 3 from the flushing position to the active position.

In this regard the actuator lever 4 comprises a driving structure 43*a*, which is a protuberance, and the gripping part 31 comprises a driven structure 33*c* which is a recess in which the driving structure 43*a* is engaged.

The actuator lever 4 comprises a shaft extending along and between two shafts forming a frame of the gripping part 31.

The actuator shaft is rotationally mounted about an actuator axis 40, and the grip member is rotationally mounted about a grip axis 30 substantially parallel to the actuator axis 40.

The grip member 3 is spring biased towards the flushing position. A grip spring 32 is provided to this end.

In the second embodiment, the grip member 3 is urged towards the active position by the actuator spring 42 through the actuator lever 4 and the driving and driven structures 43*a* and 33*a*. The actuator spring has a force overcoming the grip spring when the actuator is driving the grip member 3.

The arrangement of the actuator lever 4 of the second embodiment may comprise a retaining means 5*a* which is a bistable spring mechanism connected to the actuator lever 4 and to a bracket. The bistable spring mechanism being movable between a retaining state in which the actuator lever 4 is retained in a first position, and a releasing state in which the actuator lever 4 is released from the first position to move to a second position.

A spring based actuator lever 4 and retaining means 5*a* is a mechanical arrangement of the actuator lever. Advantageously, a mechanical arrangement is usable when there is no battery in the vehicle, and a user may access the vehicle.

The actuator lever 4 is moveable between a rest position and an activating position.

The rest position is shown in FIG. 9 and in dashed lines in FIG. 10. The activating position is shown in plane lines in FIG. 10. When the actuator lever 4 moves from the rest position to the activating position, the actuator drives the gripping part 31 by means of the driving and driven structures 43*a* and 33*a*. When the actuator lever 4 moves from the activating position to the rest position, the driving structure 43*a* releases the driven structure 33*a* such that the grip member 3 is urged by the grip spring 32 towards the flushing position.

When the actuator lever 4 is in the rest position, and the gripping part 31 is pressed from outside the vehicle, the actuator lever 4 is also pressed by means of the driven and driving structures 33*a* and 43*a* so as to make the retaining means release the actuation lever 4 to move towards the activating position. This movement is shown by reference 4*c* in FIG. 9.

The actuator lever 4 further comprises a first locking structure 41*a* opposite to the driving structure 43*a* with respect to the actuator axis 40. The grip member 3 comprises a second locking structure 31*a* opposite to the driven structure 33*a* with respect to the grip axis 40.

The locking structures are configured such that when the grip member is moved from the active position to the opening position the second locking structure 31*a* drives the first locking structure 41*a* such that the actuator lever is driven towards the rest position, and presses the retaining means so as to be retained in the rest position.

FIGS. 11, 12 show the mounting of the handle of the second embodiment. The handle comprises separate gripping part 31 and grip lever 32*a*. The grip lever 32*a* is manufactured with a handle bracket and the griping part 31 is mounted on the grip lever 31, preferably from outside the external panel 11 according to arrow 70*a*. The gripping part 31 is then fixed to the grip lever 32*a* for example by means of a screw 70.

In operation, when the grip member 3 is in the flushing position, the user wanting to open the corresponding vehicle door pushes the gripping part 31 such that the driven structure 33*a* drives the driving structure 43*a* which in turn pushes the bistable spring mechanism. The actuator lever 4 is then released from the rest position and the actuator spring 42 drives the actuator lever 4 and thus the grip member 3 toward the opening position. This is made possible through the driving and driven structures 43*a* and 33*a*, and the force of the actuator spring 42 overcoming the force of the grip spring 32.

When the grip member 3 is in the active position, the user may pull the gripping part 31 according to an opening direction 11 toward the open position such that first locking protuberance 31*a* drives the second locking protuberance 41*a* so as to drive the actuator lever 4 towards the rest position, and also make the actuator lever 4 press the retaining means 5 to make the retaining means 5 retain the actuator lever 4 in the rest position. This movement is shown in FIG. 10.

With the actuator lever retained in the rest position, the grip member 3 is free to return to the flushing position to the grip return means 32.

Referring to FIGS. 13 to 17, the handle according to a third embodiment of the invention is similar to the one of the second embodiment.

The grip member 3 has a plane shape with projections for a column 34 and for a locking structure 31*a* detailed below.

In the third embodiment, the flushing position is shown in FIGS. 14A and 14B, the active position is shown in FIGS. 15 and 16 in normal lines, and the opening position is shown by reference 3*b* in FIG. 16 and also FIG. 17.

In the third embodiment, the actuator lever 4 cooperates with the grip member 3 to block the grip member 3 from the flushing position. To this end, the grip member 3 comprises a first locking structure 31*a* and the actuator lever 4 comprises a second locking structure 41*a* cooperating with the first locking structure 31*a*.

The actuator lever 4 is moveably mounted between a locking position and an unlocking position.

In the locking position, the actuator lever 4 blocks the grip member 3 in the flushing position by means of the locking structures 31*a* and 41*a*.

In the unlocking position, the actuator lever 4 enables the grip member 3 to move towards the active position.

The actuator return means 42, which is a spring, is configured to drive the actuator lever 4 towards the locking position.

The retaining means 5 are configured to retain the actuator lever 4 in the locking position.

More particularly, the first locking structure 31*a* defines a first trajectory $T_1$ when the grip member 3 is moved from the flushing position to the active position, and in the locking position, the second locking structure 41*a* blocks the first locking structure 31*a* so as to block the grip member 3 in the flushing position.

When the actuator lever 4 is moved to the unlocking position, the second locking structure 41*a* is moved out of the first trajectory $T_1$ of the first locking structure 31*a*.

The grip member further comprises a driving structure 33 and the actuator lever 4 comprises a driven structure 43 cooperating with the driving structure 33 as shown in FIG. 14A. The opposite end of the actuator lever comprises the bistable spring arrangement. The driving and driven structures 33 and 43 are protuberances.

A bistable spring arrangement comprises a linear spring 51 on a first past and a retaining path 54 on a second part of the handle. The linear spring 51 may be attached to a bracket 1 of the handle and the retaining path 54 may be provided on the actuator lever 4 as shown in FIG. 14B. Alternatively, the opposite arrangement may be used as shown in FIG. 14C, i.e. the linear spring 51 is attached to the actuator lever 4 and the retaining path 54 is in the bracket 1 as shown in FIG. 14C.

The linear spring is urged between two positions in the retaining path 54 as the first and second parts are pressed with respect to each other.

More particularly, when the grip member 3 is in the flashing position and the gripping part is pressed from outside the door, the driving protuberance 33 drives the driven protuberance 43 such that the actuator lever 4 presses the retaining means 5 which in turn releases the actuator lever 4 from the locking position. This movement is shown in FIG. 14A. The grip member 3 is then moved towards the active position as shown in FIGS. 15 and 16.

When the grip member is in the active position and is moved to the opening position, the first locking structure 31*a* cooperates with the second locking structure 41*a* so as to drive the actuator lever 4 along a second trajectory $T_2$ such that the actuator lever 4 presses the retaining means 5 which in turn releases the actuator lever 4 from the unlocking position.

The actuator lever 4 comprises a shaft rotationally mounted about an actuator axis 40, and the grip member is rotationally mounted about a grip axis 30 substantially parallel to the actuator axis 40.

The grip member 3 is spring biased towards the active position. A grip spring 32 is provided to this end.

In the third embodiment, the actuator spring 42 drives the actuator lever towards the locking position. The actuator spring 42 has a force overcoming the grip spring 32 such that the grip member remains in the flushing position.

In operation, when the user pushes the grip member 3 and the bistable spring mechanism, the user overcomes the force of the actuator spring 42 such that the actuator lever 4 is moved from the locking position to the unlocking position. The actuator lever is then retained in the unlocking position by the retaining means 5. Such a retaining overcomes the force of the actuator spring 42.

With the actuator lever 5 retained in the unlocking position, the second locking structure 41*a* is moved out of the first trajectory $T_1$ of the first locking structure 31*a*. The first locking structure is then free to move according to the first trajectory so that the grip member is moved from the flushing position to the active position, by means of the grip return means 32.

When the grip member 3 is in the active position, the user may pull the gripping part 31 according to an opening direction 11 toward the open position such that first locking protuberance 31*a* drives the second locking protuberance 41*a* according to a second trajectory 41 such that the actuator lever 4 presses the bistable spring mechanism which releases the actuator lever 4 to move towards the locking position, by means of the force of the actuator spring 42. This movement is shown by FIG. 16, in particular references 3*b* and 4*d*.

The grip member 3 also moves towards the flushing position as the force of the actuator spring 42 overcomes the force of the grip spring 32.

When the grip member 3 is in the active position, the user may also push the gripping part 31 towards the flushing position such that driving protuberance 33 drives the driven protuberance 43 and such that the actuator lever 4 presses the bistable spring mechanism which releases the actuator lever 4 to move towards the locking position, by means of the force of the actuator spring 42. This movement is shown by FIG. 17, in particular by movements $I_2$ and $I_3$.

The grip member 3 is maintained in the flushing position as the force of the actuator spring 42 overcomes the force of the grip spring 32.

The invention has been described above with the aid of embodiments without limitation of the general inventive concept as defined in the claims.

Many modifications and variations will suggest themselves to those skilled in the art upon making reference to the foregoing illustrative embodiments, which are given by way of example only and which are not intended to limit the scope of the invention, that being determined solely by the appended claims.

A protuberance on a first part cooperating with a recess on a second part, such that one of the parts drive the other, may alternatively be implemented with a different arrangement, i.e. one or more protuberance(s) and/or one or more recess(es) cooperating with each other where applicable.

In the claims, the word "comprising" does not exclude other elements or steps, and the indefinite article "a" or "an" does not exclude a plurality. The mere fact that different features are recited in mutually different dependent claims does not indicate that a combination of these features cannot be advantageously used. Any reference signs in the claims should not be construed as limiting the scope of the invention.

The invention claimed is:

1. A handle for a vehicle door, comprising:

an activation member configured to activate a latch of a vehicle door so as to unlatch the door;

a grip member configured to cooperate with the activation member so as to unlatch the door, wherein the grip member comprises a gripping part and a grip lever, the gripping part being movable between:

a flushing position in which the gripping part extends flush to an external panel of the door, wherein the grip lever does not cooperate with the activation member, and an active position in which the gripping part projects with respect to the external panel and becomes graspable, and the grip lever cooperates with the activation member, and an opening position in which the grip lever drives the activation member to activate the latch and unlatch the door; and a driving mechanism and an actuator lever cooperating directly with the grip lever to drive the gripping part between the flushing position and the active position, the handle being configured such that when the gripping part is pulled according to an opening direction, the grip lever drives the activation member which in turn activates the latch to unlatch the door, wherein the grip lever defines a grip axis, a first arm for rotatably mounting the gripping part to rotate about the grip axis and a second arm configured to drive the activation member, and the actuator lever is rotatably mounted about an actuator axis, the grip axis and the actuator axis being substantially parallel to each other.

2. The handle according to claim 1, further comprising:

a grip return means configured to drive the gripping part towards the flushing position, wherein the actuator lever is moveable between:

an activating position in which the actuator lever drives the gripping part towards the active position, and a rest position in which the actuator lever releases the gripping part; and an actuator return means configured to drive the actuator lever towards the activating position; and a retaining means for retaining the actuator lever in the rest position.

3. The handle according to claim 1, further comprising:

a grip return means configured to drive the gripping part towards the active position, wherein the actuator lever is moveable between:

a locking position in which the actuator lever blocks the gripping part in the flushing position, and an unlocking position in which the actuator lever enables the gripping part to move towards the active position;

an actuator return means configured to drive the actuator lever towards the locking position, and a retaining means for retaining the actuator lever in the unlocking position.

4. The handle according to claim 2, wherein the retaining means comprises a pressure sensitive bistable spring mechanism connected to the actuator lever and to a bracket, the bistable spring mechanism being movable between a retaining state in which the actuator lever is retained in the rest position or in the unlocking position, and a releasing state in which the actuator lever is released from said position.

5. The handle according to claim 2, wherein the retaining means comprises a clicking means configured to produce a clicking sound when the actuator lever is released from the rest position or from the unlocking position.

6. The handle according to claim 1, further comprising:

at least one first switch; and a first circuit, closed by a contact between the activation member and the grip member.

7. The handle according to claim 6, further comprising:

at least one second switch on the motor or on the actuator lever; and at least one second circuit, the at least one second switch and the second circuit being configured to inform a user on the state of the actuator lever.

8. The handle according to claim 2 wherein the grip member comprises a driven structure and the actuator lever comprises a driving structure cooperating with the driven structure, wherein, when the actuator lever is moved from the rest position to the activating position, the driving structure drives the driven structure such that the gripping part is moved from the flushing position to the active position.

9. The handle according to claim 4, wherein the grip member comprises a first locking structure and the actuator lever comprises a second locking structure cooperating with the first locking structure, wherein when the gripping part is moved from the active position to the opening position, the first locking structure drives the second locking structure so as to drive the actuator lever towards the rest position such that the actuator lever presses and is retained by the retaining means.

10. The handle according to claim 3, wherein the grip member comprises a first locking structure defining a first trajectory when the gripping part is moved from the flushing position to the active position, and the actuator lever comprises a second locking structure, wherein in the locking position, the second locking structure blocks the first locking structure so as to block the gripping part in the flushing position, and wherein in the unlocking position, the second locking structure is moved out of the first trajectory of the first locking structure.

11. The handle according to claim 4, wherein the grip member comprises a driving structure and the actuator lever comprises a driven structure cooperating with the driving structure such that when the gripping part is in the flushing position and the gripping part is pressed from outside the door, the driving structure drives the driven structure such that the actuator lever presses the retaining means which in turn releases the actuator lever from the unlocking position.

12. The handle according to claim 3, wherein when the gripping part moves from the active position to the opening position, the first locking structure cooperates with the second locking structure so as to drive the actuator lever along a second trajectory such that the actuator lever presses the retaining means which in turn releases the actuator lever from the unlocking position.

13. The handle according to claim 1, wherein the grip member comprises a column projecting towards the external panel and the column comprises a first opening protuberance cooperating with a second opening protuberance on the activation member to unlatch the vehicle door, wherein the driving structure is on the column.

14. The handle according to claim 7, wherein the actuator lever has two opposite ends, and wherein the second locking structure is placed at one end and the driven structure is placed at the opposite end.

15. A handle for a vehicle door, comprising:

an activation member configured to activate a latch of a vehicle door so as to unlatch the door;

a grip member configured to cooperate with the activation member so as to unlatch the door, wherein the grip member comprises a gripping part and a grip lever, the gripping part being movable between:

a flushing position in which the gripping part extends flush to an external panel of the door, wherein the grip lever does not cooperate with the activation member, an active position in which the gripping part projects with respect to the external panel and becomes graspable, and the grip lever cooperates with the activation member, and an opening position in which the grip lever drives the activation member to activate the latch and unlatch the door;

a grip return means configured to drive the gripping part towards the flushing position;

an actuator lever cooperating directly with the grip lever to drive the gripping part between the flushing position and the active position, wherein the actuator lever is moveable between:

an activating position in which the actuator lever drives the gripping part towards the active position, and a rest position in which the actuator lever releases the grip lever, an actuator return means configured to drive the actuator lever towards the activating position; and a retaining means for retaining the actuator lever in the rest position, the handle being configured such that when the gripping part is pulled according to an opening direction, the grip lever drives the activation member which in turn activates the latch to unlatch the door, wherein the grip lever defines a grip axis, a first arm for rotatably mounting the gripping part to rotate about the grip axis and a second arm configured to drive the activation member, and the actuator lever is rotatably mounted about an actuator axis, the grip axis and the actuator axis being substantially parallel to each other.

16. A handle for a vehicle door, comprising:

an activation member configured to activate a latch of a vehicle door so as to unlatch the door;

a grip member configured to cooperate with the activation member so as to unlatch the door, wherein the grip member comprises a gripping part and a grip lever, the gripping part being movable between:

a flushing position in which the gripping part extends flush to an external panel of the door, wherein the grip lever does not cooperate with the activation member, an active position in which the gripping part projects with respect to the external panel and becomes graspable, and the grip lever cooperates with the activation member, and an opening position in which the grip lever drives the activation member to activate the latch and unlatch the door;

a grip return means configured to drive the gripping part towards the active position;

an actuator lever cooperating directly with the grip lever to drive the gripping part between the flushing position and the active position, wherein the actuator lever is moveable between:

a locking position in which the actuator lever blocks the gripping part in the flushing position, and an unlocking position in which the actuator lever enables the gripping part to move towards the active position, an actuator return means configured to drive the actuator lever towards the locking position; and a retaining means for retaining the actuator lever in the unlocking position, wherein the grip lever defines a grip axis, a first arm for rotatably mounting the gripping part to rotate about the grip axis and a second arm configured to drive the activation member, and the actuator lever is rotatably mounted about an actuator axis, the grip axis and the actuator axis being substantially parallel to each other.

17. A handle for a vehicle door, comprising:

an activation member configured to activate a latch of a vehicle door so as to unlatch the door;

a grip member configured to cooperate with the activation member so as to unlatch the door, wherein the grip member comprises a gripping part and a grip lever, the gripping part being movable between:

a flushing position in which the gripping part extends flush to an external panel of the door, wherein the grip lever does not cooperate with the activation member, and an active position in which the gripping part projects with respect to the external panel and becomes graspable, and the grip lever cooperates with the activation member, and an opening position in which the grip lever drives the activation member to activate the latch and unlatch the door; and a driving mechanism and an actuator lever cooperating directly with the grip lever, the driving mechanism comprising a motor configured to drive the actuator lever which in turn drives the gripping part between the flushing position and the opening position, wherein the handle is configured such that when the gripping part is pulled according to an opening direction, the grip lever drives the activation member which in turn activates the latch to unlatch the door, wherein the grip lever defines a grip axis, a first arm for rotatably mounting the gripping part to rotate about the grip axis and a second arm configured to drive the activation member, and the actuator lever is rotatably mounted about an actuator axis, the grip axis and the actuator axis being substantially parallel to each other.

* * * * *